US010396476B2

(12) United States Patent
Stjepanovic et al.

(10) Patent No.: US 10,396,476 B2
(45) Date of Patent: Aug. 27, 2019

(54) CONDUCTOR CONNECTION DEVICE

(71) Applicant: Weidmüller Interface GmbH & Co. KG, Detmold (DE)

(72) Inventors: Karlo Stjepanovic, Bielefeld (DE); Stephan Fehling, Lage (DE)

(73) Assignee: Weidmüller Interface GmbH & Co. KG (DE)

( * ) Notice: Subject to any disclaimer, the term of this patent is extended or adjusted under 35 U.S.C. 154(b) by 0 days.

(21) Appl. No.: 15/761,177

(22) PCT Filed: Sep. 16, 2016

(86) PCT No.: PCT/EP2016/071925

§ 371 (c)(1),
(2) Date: Mar. 19, 2018

(87) PCT Pub. No.: WO2017/050643

PCT Pub. Date: Mar. 30, 2017

(65) Prior Publication Data

US 2018/0277968 A1 Sep. 27, 2018

(30) Foreign Application Priority Data

Sep. 22, 2015 (DE) ..... 20 2015 105 022 U

(51) Int. Cl.

| | |
|---|---|
| ***H01R 11/09*** | (2006.01) |
| ***H01R 4/48*** | (2006.01) |
| ***H01R 25/16*** | (2006.01) |
| *H01R 9/24* | (2006.01) |

(52) U.S. Cl.

CPC ..... *H01R 11/09* (2013.01); *H01R 4/4827* (2013.01); *H01R 25/162* (2013.01); *H01R 9/2408* (2013.01)

(58) Field of Classification Search

CPC ..... H01R 4/4827; H01R 11/09; H01R 25/162
USPC ..... 439/724, 441, 409
See application file for complete search history.

(56) References Cited

U.S. PATENT DOCUMENTS

| | | | | |
|---|---|---|---|---|
| 3,135,822 A * | 6/1964 | Baran | H01F 27/40 | 174/59 |
| 4,722,701 A * | 2/1988 | Bradt | H01H 85/2035 | 439/620.33 |
| 6,109,952 A * | 8/2000 | Jaag | H01R 4/4827 | 439/224 |
| 6,270,384 B2 * | 8/2001 | Jaag | H01R 4/4827 | 439/729 |

(Continued)

FOREIGN PATENT DOCUMENTS

| | | |
|---|---|---|
| DE | 19832593 C1 | 1/2000 |
| DE | 10023851 A1 | 11/2001 |

(Continued)

*Primary Examiner* — Abdullah A Riyami
*Assistant Examiner* — Vladimir Imas
(74) *Attorney, Agent, or Firm* — Laubscher & Laubscher, P.C.

(57) ABSTRACT

A connection device for conductors has one or more single conductor terminals which are formed as direct plug connections. Each conductor terminal has a metal contact element such as a metal clamping cage, a spring support made of a non-conductive material such as plastic, and a clamping spring. Each of the spring supports is placed on at least one corresponding receiving element made of a non-conductive material.

21 Claims, 9 Drawing Sheets

(56) References Cited

U.S. PATENT DOCUMENTS

| | | | | |
|---|---|---|---|---|
| 6,422,884 | B1 * | 7/2002 | Babasick | H01R 13/5812 439/222 |
| 6,786,779 | B2 * | 9/2004 | Feldmeier | H01R 4/4827 439/729 |
| 6,806,424 | B2 | 10/2004 | Gervin | |
| 7,329,143 | B2 * | 2/2008 | Schrader | H01R 4/4827 439/441 |
| 7,658,639 | B2 * | 2/2010 | Hoppmann | H01R 4/4827 439/142 |
| 7,674,140 | B2 * | 3/2010 | Eppe | H01R 4/4827 439/816 |
| 7,785,134 | B2 * | 8/2010 | Dhandapani | H01R 4/4818 439/441 |
| 8,485,841 | B2 | 7/2013 | Schrader | |
| 8,794,994 | B2 * | 8/2014 | Kollmann | H01R 4/4836 439/441 |
| 8,858,269 | B2 * | 10/2014 | Brand | H01R 4/4827 439/733.1 |
| 9,083,115 | B2 | 7/2015 | Hoppmann et al. | |
| 9,160,085 | B2 * | 10/2015 | Jun | H01R 4/4827 |
| 9,437,940 | B1 * | 9/2016 | Rao | H01R 4/4836 |
| 9,537,228 | B2 * | 1/2017 | Wendt | H01R 4/5008 |
| 9,553,387 | B2 * | 1/2017 | Tedeschi | H01R 13/42 |
| 9,761,964 | B2 * | 9/2017 | Meyer | H01R 4/4836 |
| 9,960,505 | B2 * | 5/2018 | Spey | H01R 9/2608 |
| 2014/0065892 | A1 | 3/2014 | Jun | |
| 2016/0211591 | A1 | 7/2016 | Herrmann et al. | |

FOREIGN PATENT DOCUMENTS

| | | | |
|---|---|---|---|
| DE | 102011115637 | A1 | 12/2012 |
| DE | 102014113086 | A1 | 3/2015 |
| WO | 02073747 | A1 | 9/2002 |
| WO | 2010079130 | A1 | 7/2010 |
| WO | 2011099863 | A1 | 8/2011 |

* cited by examiner

Fig. 5a
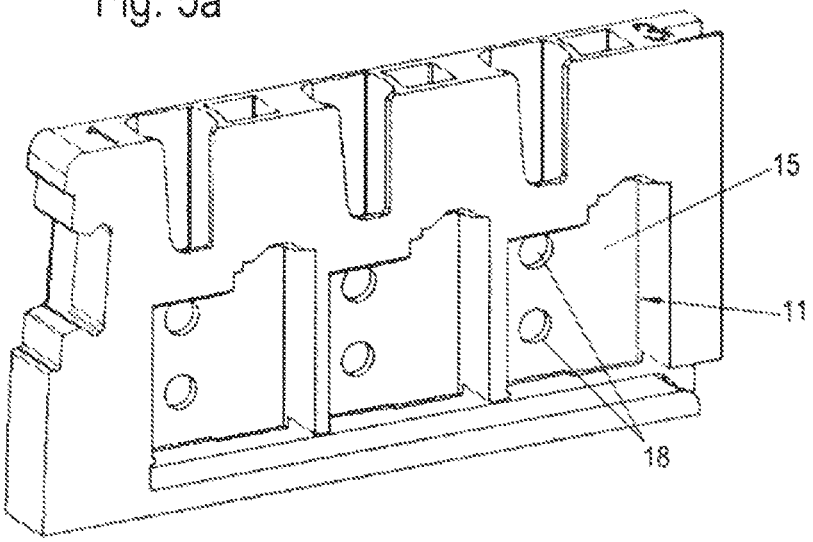
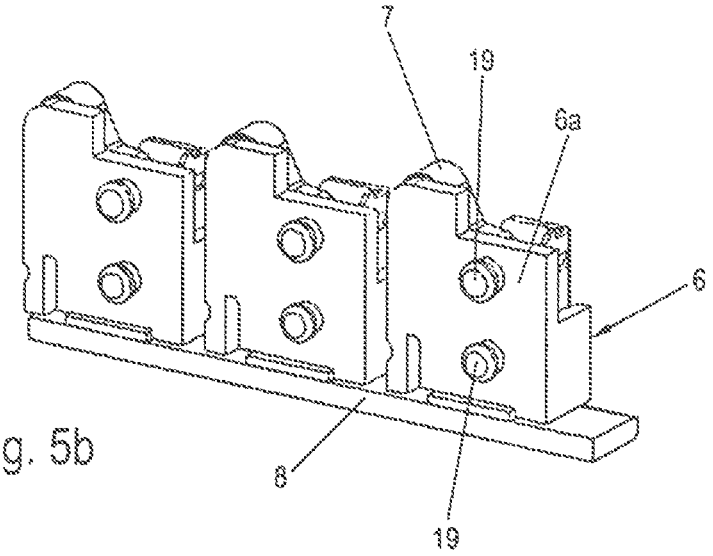
Fig. 5b

CONDUCTOR CONNECTION DEVICE

CROSS-REFERENCE TO EARLIER APPLICATIONS

This application is a § 371 of PCT/EP2016/071925 filed Sep. 16, 2016. PCT/EP2016/071925 claims priority of DE 20 2015 105 022.4 filed Sep. 22, 2015. The entire contents of these applications are incorporated herein by reference.

BACKGROUND OF THE INVENTION

The invention relates to a conductor connection device.

Such connection devices are known in the art. A general disadvantage of the known solutions is the complex structure which makes it difficult to use the connection device for various applications.

The present invention was developed to overcome the drawbacks of prior connection devices by providing a conductor connection devices suitable for various applications. In addition, the invention is directed toward a terminal block or a plug with a housing and at least one connection device.

SUMMARY OF THE INVENTION

According to a first embodiment of the invention, a conductor connection device includes at least one spring support formed of a non-conductive material which is connected with a corresponding receiving element made of a non-conductive material. This embodiment makes it possible to easily use the conductor terminal in a variety of ways, e.g., as a single-conductor terminal, in a further assembly, as one conductor terminal of a double-conductor terminal, or as a single-conductor or double-conductor terminal for terminal blocks or plugs.

At least one mounting device is formed on one or more of the spring supports for mounting the spring support made of a non-conductive material, in particular plastic, on a corresponding receiving element made of a non-conductive material, in particular of plastic. This embodiment makes it especially easy to use the single conductor terminal in a wide variety of ways.

A receiving element for at least one spring support is also a receiving element for a further spring support. This makes it possible to form double-spring supports and therefore also double-conductor terminals in a simple fashion.

However, it is also advantageous if the receiving element for at least one spring support is a housing, in particular a terminal-block housing or a plug housing. Preferably, the spring support, the clamping cages and the clamping springs are pre-mountable on a busbar. The assembly may then be inserted in a housing. This allows for locking the bushar on the housing. However, it is also conceivable to fasten the individual spring supports on the housing (terminal-block housing or plug housing), if single-conductor terminals are provided.

According to a preferred embodiment, one or more mounting devices on the spring support include one or more interlocking devices. In this case, one or more corresponding interlocking devices are provided on the receiving element, in particular on a further spring support, or on or inside the housing. The corresponding interlocking devices are designed as pins and holes that may be clamped together.

It is advantageous if the clamping cage is U-shaped with a clamping-cage rear wall and two clamping-cage sidewalls extending perpendicularly to the rear wall, and preferably a base wall and/or a base socket extending perpendicularly to the clamping-cage rear wall and the clamping-cage sidewalls in order to mount the relevant clamping cage on a busbar. The spring supports are preferably U-shaped with a base wall and two sidewalls extending perpendicularly to the base wall. Therefore, if the spring supports are U-shaped and the clamping cages also are U-shaped, then the spring supports and the clamping cages may each be combined into one body with a rectangular contour, whereby the clamping spring is well protected and the conductor routing to the clamping point is realized in a simple way.

It is furthermore advantageous in terms of mounting, if one or all spring supports have one or more spring-retaining contours extending perpendicularly to the base wall, such that a V-shaped clamping spring may be attached thereto and has a support leg and a clamping leg arranged at an acute angle thereto ($10° < \alpha < 90°$), whereby the support leg and the clamping leg are interconnected via a spring back and the spring back of the relevant clamping spring engages over the spring-retaining contour of the spring support.

According to a preferred embodiment, some of the conductor terminals are arranged one behind the other on the busbar in its main extension direction.

According to another embodiment, two of the single-conductor terminals are combined into one or more primary double-conductor terminals with two spring supports combined on the corresponding mounting devices, two of the clamping springs and two of the clamping cages. This allows for these two single-conductor terminals of the double-conductor terminal to have clamping locations that are situated in the same location or offset in the main extension direction of the busbar. This flexibility is only possible, since each single-conductor terminal of the respective single-conductor terminal has a single spring support, unlike in the prior art.

According to a further embodiment of the invention, a spacer, which may be attached to the spring support in order to increase its width, is provided. This spacer preferably has a base wall on one side or mounting devices on both sides which are designed to correspond with the mounting devices for the spring support, such that one or two of the spring supports may be mounted on the spacer. This allows for a wide variety of contact grid widths to be realized in a simple manner.

BRIEF DESCRIPTION OF THE FIGURES

The invention will be described in greater detail below with reference to the accompanying drawing, in which:

FIGS. 5*a* and *b* are perspective views of a further terminal housing and a fifth conductor connection device, respectively;

DETAILED DESCRIPTION

Figure 1A:
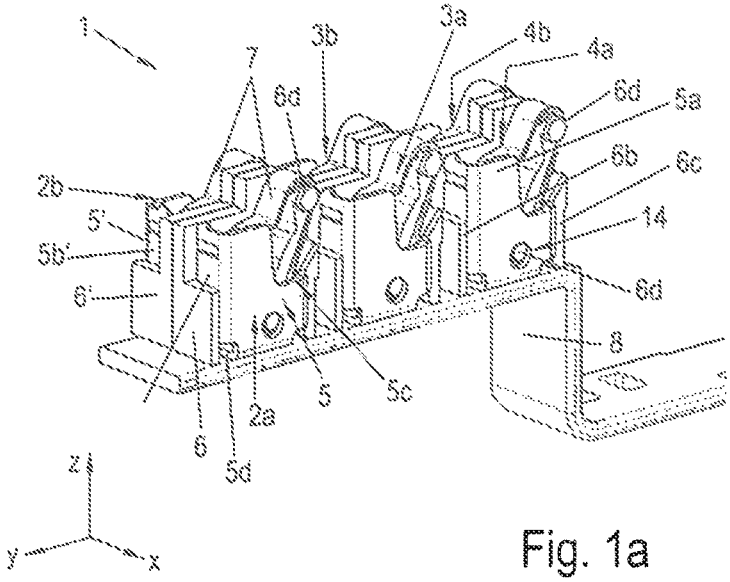
FIG. 1*a* is a perspective view of a first conductor connection device.

FIG. 1 shows a first embodiment of a conductor connection device 1. This connection device 1 is designed as a multi-conductor terminal and allows for the connection of six conductor ends, not shown.

For this purpose, the connection device has six single-conductor terminals 2*a*, 2*b*; 3*a*, 3*b*, 4*a*, 4*b*, which are combined in FIG. 1 to form three primary double-conductor terminals, each serving to connect two of the conductors.

The single-conductor terminals 2*a*, 2*b*; 3*a*, 3*b*; 4*a*, 4*b* are each designed as direct plug-in (or push-in) connections. Each of the individual conductor terminals 2*a*, 2*b*; 3*a*, 3*b*; 4*a*, 4*b* have a metallic contact element, in particular, a clamping cage 5 or 5', a spring support 6 or 6' made of a non-conductive material such as a non-conductive plastic, as well as a clamping spring 7. Thus, a self-contained, functional single-conductor terminal is formed which may be combined with further single-conductor terminals to form primary assemblies.

In plan view, each clamping cage 5 or 5' is U-shaped with a clamping-cage rear wall 5*a* or 5*a'* and two clamping-cage sidewalls 5*b*, 5*c* or 5*b'*, 5*c'* extending perpendicularly thereto. Moreover, each clamping cage has a base wall and/or a base socket 5*d* or 5*d'* extending perpendicularly to the rear wall 5*a* or 5*a'* and the clamping-cage sidewalls 5*b*, 5*c*. The clamping-cage base wall 5*d* or 5*d'* serves to attach the relevant clamping cage 5 or 5' to a busbar 8. For this reason, the base wall 5*d* or 5*d'* is preferably soldered or welded to the busbar 8.

The clamping cages 5 or 5' are arranged one behind the other in a longitudinally extending direction Y of the busbar 8. Since the clamping cages 5 are not formed integrally with the busbar 8, but rather secured thereto, the clamping cages may be arranged in the longitudinally extending direction Y closely behind one another. In particular, their distance in the Y-direction may be a great deal smaller than the longitudinal extension of the clamping cages 5. A conductive contact element or clamping cage 5 may also have only one or two conductive legs, although preferably more than two walls/legs are provided thereon.

Figure 4A:
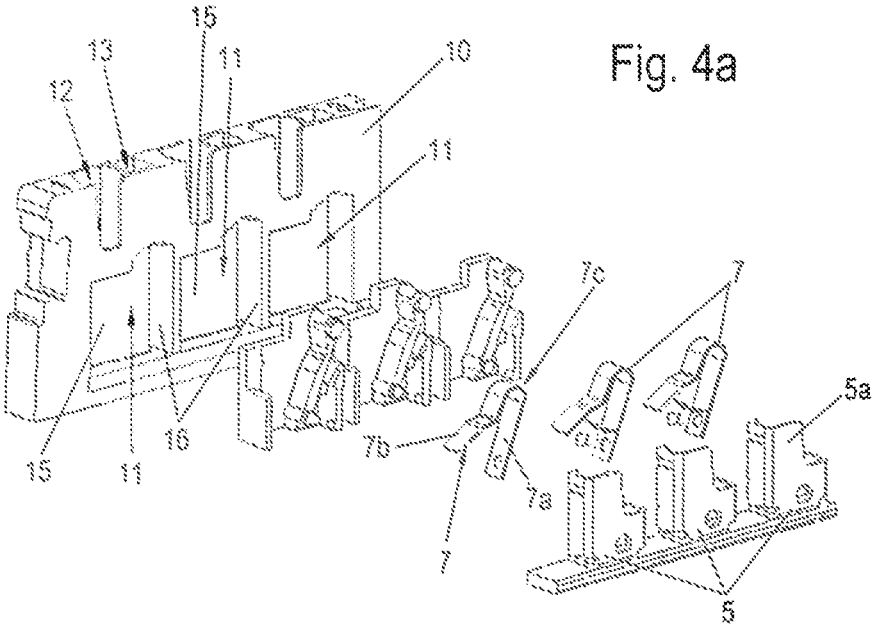
FIGS. 4*a-d* are perspective views, respectively, of the four steps of the assembly of a terminal housing with a fourth conductor connection device.

In plan view, the spring supports 6 or 6' are U-shaped as shown in FIG. 4*a* with a base wall 6*a* or 6*a'* and two sidewalls 6*h*, 6*c* or 6*h'*, 6*c'* extending perpendicularly thereto. At least one spring-retaining contour 6*d* or 6*d'* extends perpendicularly to the base wall 6*a*. Moreover, the spring supports 6' have mounting devices—in particular interlocking devices—on their rear walls 6*a*, 6*a'*, which are designed to interact with corresponding mounting devices—in particular also interlocking devices—on a receiving element. This receiving element, which may be a further spring support 6 or 6' or a housing plug or clamp, is designed to attach and mount the respective spring support 6, 6' or several of the spring supports 6, 6' on a receiving element, and may be shaped in various ways as will be explained in more detail below.

The clamping spring 7 is substantially V-shaped as shown in FIG. 4*a* and has a support leg 7*a* and a clamping leg 7*b* arranged at an acute angle thereto, i.e., in an angle of $10° < \alpha < 90°$. The support leg 7*a* and the clamping leg 7*b* are interconnected via a spring back 7*c*.

The spring supports 6 and 6' are designed such that the clamping springs 7 are attachable thereto. For this purpose, the spring back 7*c* engages over the spring-retaining contour 6*d*, 6*d'* of the spring support 6, 6'. The support leg 7*a* is preferably situated between the spring-retaining contour 6*d*, 6*d'* and either of the two sidewalls 6*b*, 6*b'*. The spring-retaining contour 6*d*, 6*d'* is preferably aligned obliquely in a spring angle of preferably $0 < \beta < 60°$ relative to the conductor insertion direction Z.

Furthermore, the spring-retaining contour 6*d*, 6*d'* is preferably long enough so that it extends over the entire length of the support leg 7*a* of the clamping spring 7. This allows for easy pre-assembly of the clamping spring 7. In addition, the spring-retaining contour 6*d* or 6*d'* may each form an end stop which limits the opening movement of the clamping leg 7*b* of the clamping spring 7. The spring-retaining contour 6*d* or 6*d'* may also include several individual sections.

Figure 2A:
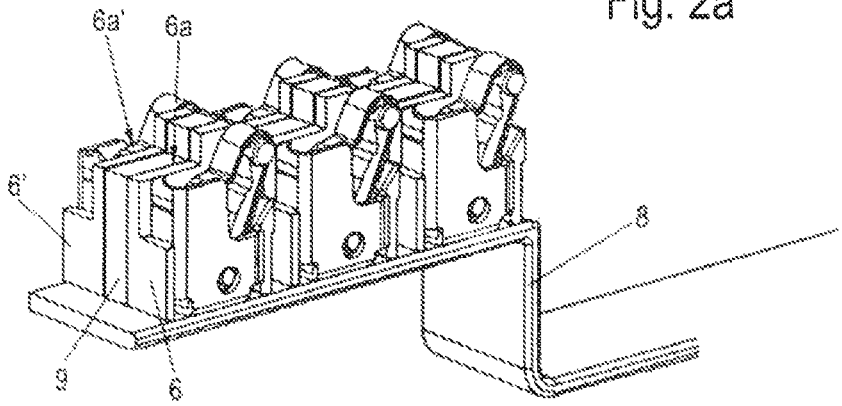
FIG. 2*a* is a perspective view of a second conductor connection device.
Figure 2B:
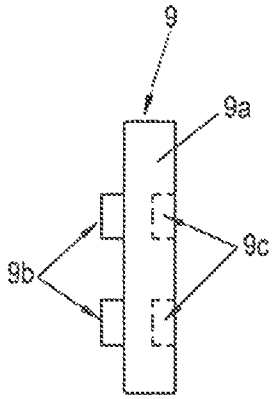
FIGS. 2*b* and 2*c* are front and side views of a spacer of the connection device of FIG. 2*a;*
Figure 2C:
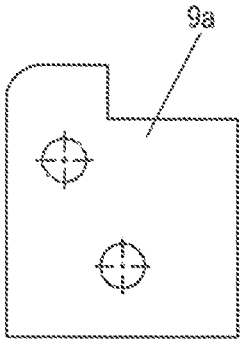

Each of the double-conductor terminals in FIG. 1*a* or FIG. 2*a* composed of the conductor terminals 2*a*, 2*b*; 3*a*, 3*b*; and 4*a*, 4*b* has two spring supports 6, 6' and two clamping springs 7, 7'.

Figure 1B:
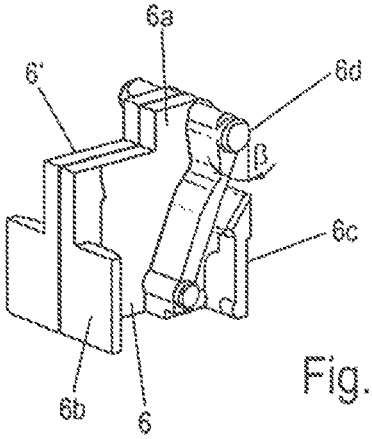
FIG. 1*b* is a perspective view of a spring support of the connection device of FIG. 1*a* in the assembled state.
Figure 1C:
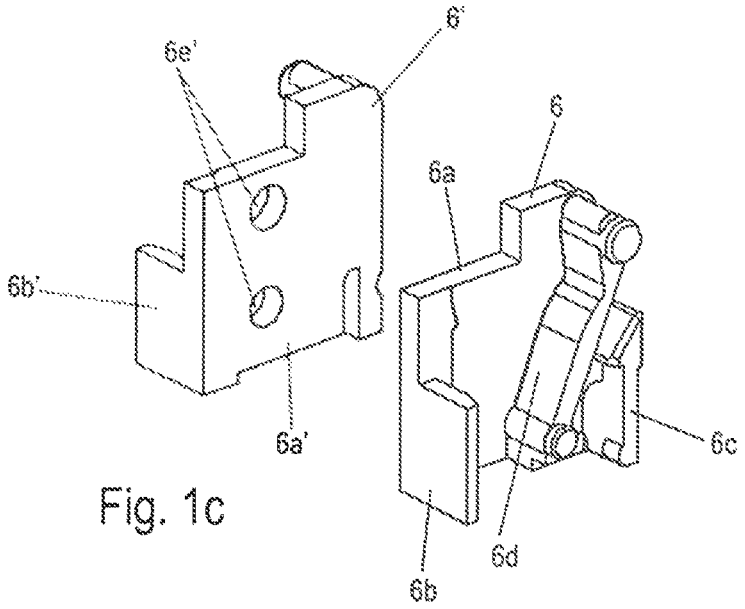
FIGS. 1*c* and 1*d* are front and rear exploded perspective views, respectively of the spring support of FIG. 1*b;*
Figure 1D:
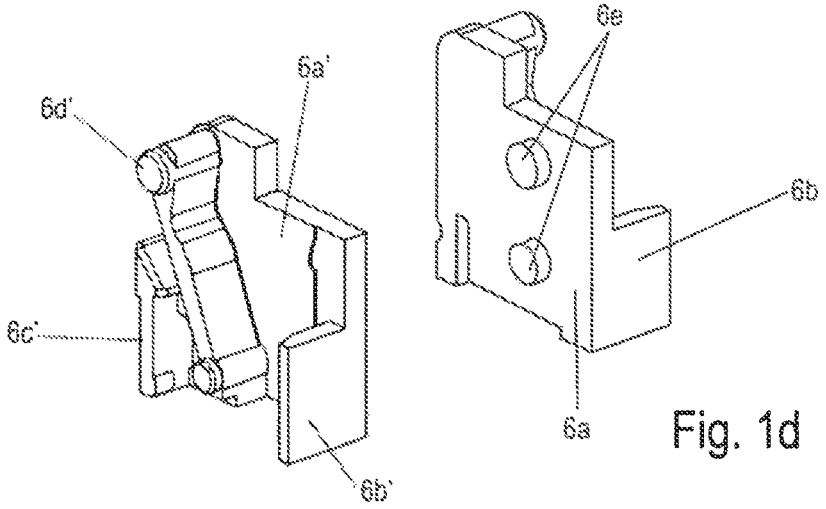
Figure 1E:
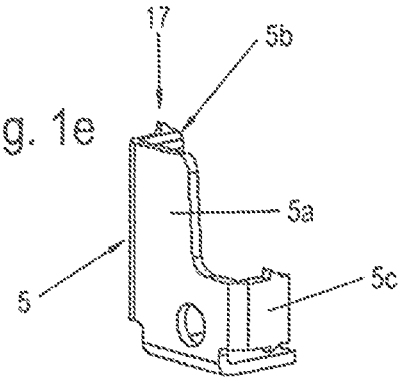
FIG. 1*e* is a perspective view of a clamping cage.
Figure 1F:
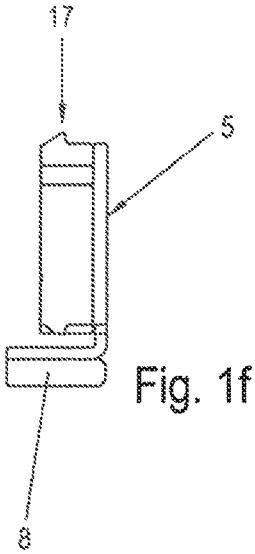
FIG. 1*f* is a front view of the clamping cage mounted on a busbar.

Preferably, some interlocking devices are formed as pins 6*e* and the corresponding interlocking devices as corresponding holes 6*e'* which serve as clamping receptacles for the pins 6*e* as shown in FIGS. 1*c* and 1*d*. Alternatively, the pins and holes serve as latching devices and latching receptacles. These interlocking devices are preferably formed on the sides of the rear walls 6*a*, 6*a'* facing away from the spring-retaining contours. Thus, the rear walls 6*a* and 6*a'* may be placed adjacent and fastened to one another, thereby forming a type of double-spring support, upon which one of the clamping springs 7, 7' may be arranged on two sides facing away from one another or arranged in a mounted state.

The spring supports 6 and 6' are preferably formed symmetrically, except with respect to the mounting devices, relative to a plane X-Y, which extends between the adjacent rear walls. The mounting devices for the spring support 6 and 6' thus interact. Here, the mounting devices for the spring support 6 are formed as one or more pins 6*e* on the rear of the base wall 6*a* on the side facing away from the clamping spring 7. In contrast, the mounting devices for the spring support 6' are formed as one or more of the corresponding holes 6*e'*. Thus, spring supports 6 and 6' may be combined into a type of double-spring support as shown in FIGS. 1*b*, 1*c*, and 1*d* such that their rear walls are adjacent to one another and their mounting devices hold them together.

In the manner described above, the single-spring support may easily be combinable into a double-spring support.

On the spring support 6, 6' or the assembled double-spring support including the spring supports 6 and 6', two of the clamping springs 7 are attachable or pre-assembled. The double-spring support including the two spring supports 6, 6' with the two clamping springs 7, 7' may be attached from above onto the busbar 8 with the clamping cages 5 fastened thereon. This busbar 8 may then be arranged in a primary housing and again locked in position to further mounting devices suitable for these purposes, such as latching edges or the like, which will be explained further below.

According to FIGS. 1-6, one of the clamping-cage sidewalls 5*b* or 5*b'* of the clamping cages 5 or 5' preferably engages between the clamping legs 7*b* of the respective clamping spring 7 and one sidewall 6*b* or 6*b* of the spring support 6 or 6' and preferably the sidewall 5*c* or 5*c'* of the clamping cages 5 or 5' between the support legs 7*a* of the respective clamping spring 7 and the other sidewall 6*c* or 6*c'* of the spring support 6 or 6'. The support leg 7*a* is thus preferably supported on a metallic element.

Altogether, the respective spring support 6, 6' and the clamping cage 5, 5' form a rectangular closed geometry with both rear walls 5*a*, 5*a'*; 6*a*, 6*a'* or sidewalls 5*b*, 6*b* and 5*c*, 6*c*; 5*b'*, 6*b'* or 5*c'*, 6*c'*. The spring support 6 and the clamping cages 5 engage each other and form a rectangular body. Thus, the clamping spring 7 and a conductor to be connected are well protected. In particular, fine-wire conductors are easily connected due to the advantageous conductor-routing feature.

Optionally, the clamping cage 5 may be further reduced, e.g., it may be limited to a single contact leg on, which clamping leg 7*a* is supported and which is connected to the busbar 8 integrally or via a connection such as a soldering or welding joint.

Between the spring support 6 and 6', which would form a "dual spring support" in the combined state according to FIG. 1*b*, spacers may also be placed in a manner similar to partitions 9. Such a spacer or partition 9 is shown in a side view in FIG. 2*b* and in a rear view in FIG. 2*c*.

The spacer has a base wall 9*a* and mounting devices, preferably on both main sides of the base wall 9*a*, which are similar to the mounting devices for spring supports 6 and 6' and/or correspond to these supports. Thus, the spacer 9 on one side of the base wall 9*a* has as mounting devices, in particular interlocking devices, one or more pins 9*b*, and as mounting devices on the other side, holes 9*c* corresponding in particular to interlocking devices. These interact with the mounting devices which are the pins and holes of the spring support 6 and 6'. Thus, spacer 9 may be placed between the base walls 6*a* and 6*a'* of the spring supports 6 and 6' of the double-spring supports as shown in FIG. 1*a*. In this way, it is possible to provide a double-spring support with a modified (greater) width. The width of the partition wall 9 is variable, such that a double-spring support of different width may be formed in a simple way. Also, the partition wall 9 could form a spring support even with a corresponding contour presentation, such that a clamping spring and at least one center connection for conductors may be formed thereon.

The advantage of parallel mounting both individual conductor terminals 2*a*, 2*b* to 4*a*, 4*b* of the double-conductor terminals from either side (right and left) should also be mentioned. There is no need for turning the elements, which makes for easy assembly as shown in FIGS. 1 and 2.

Altogether, the connection device of FIG. 1 or that of FIG. 2 is formed in a simple way with several double-conductor terminals that are accommodated within a small space on a busbar 8. This connection device, as a whole, may be placed in a housing, e.g., a terminal-block housing as shown in FIGS. 4, 5 and 6 with at least one corresponding clearance.

Figure 3A:
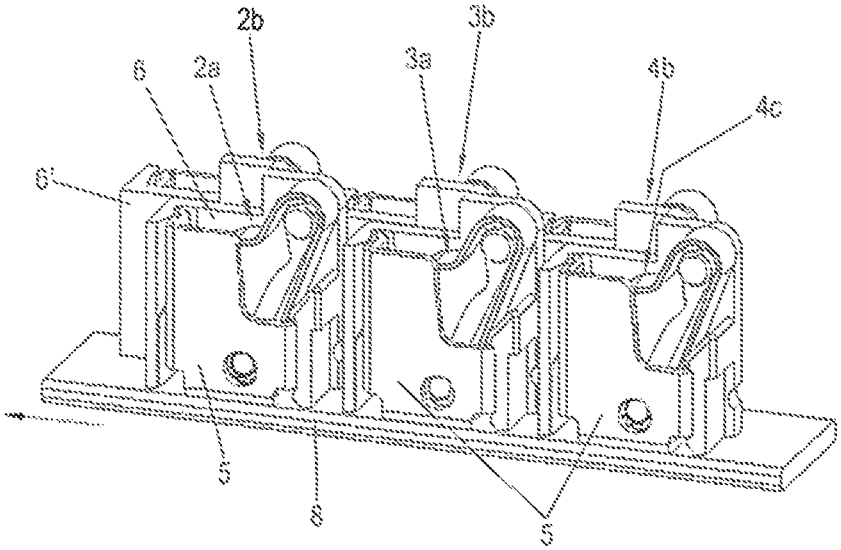
FIG. 3*a* is a perspective view of a third conductor connection device.
Figure 3B:
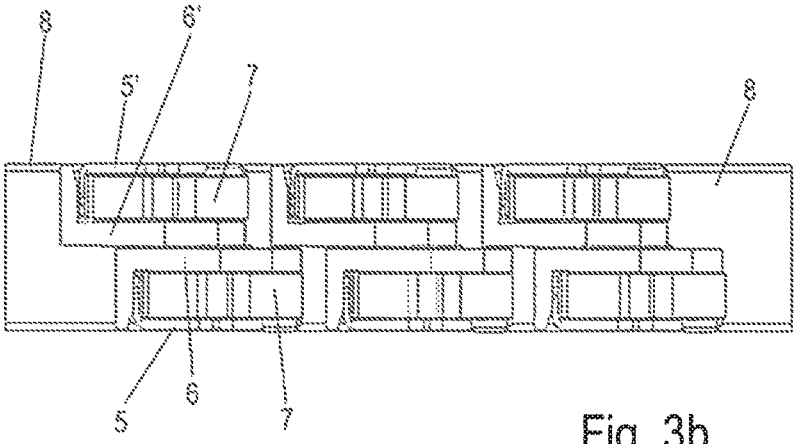
FIG. 3*b* is a top plan view of the connection device of FIG. 3*a;*

Alternatively, it is possible to arrange the mounting devices, in particular the interlocking devices, of the spring support at such different positions of the rear walls of the spring supports 6, 6' that overall, an offset arrangement of both single-conductor terminals 2*a*, 2*b* to 4*a*, 4*b* of the primary double-conductor terminals in the main extension direction Y of the busbar 8 is provided as shown in FIG. 3. A spacer 9 may be used to vary the width. If an individual conductor terminal 2*a*, 2*b* is offset in the busbar direction Y against its adjoining conductor terminal, not only a conductor may be connected, but also a wider test plug or the like may be connected in each of the two conductor terminals, 2*a*, 2*b*. The term "conductor terminal" should therefore not be interpreted as limited to the connection of conductors, but rather indicates that in principle suitability for connecting a conductor exists.

According to FIGS. 1 and 2, two of the single-conductor terminals are combined with two double-wire terminals at the same clamping points as shown in FIGS. 1 and 2 or at clamping points that are offset on the busbar 8 in the main extension direction as shown in FIG. 3.

According to another embodiment of the invention, the spring supports 6 or 6' are not combined to form double-spring supports or even triple- or quadruple-spring supports. Single-conductor terminals are formed and installed in this way. FIG. 4 shows such an embodiment. Accordingly, a terminal-block housing 10 with one or more clearances 11 is provided.

The clearance or clearances 11 in the terminal-block housing are dimensioned such that a busbar 8' in the housing 10 is replaceable and upon which busbar, one or more individual conductor terminals 2*a*, 2*b*, 2*c* are arranged in a row, one behind the other, each having one of the spring supports 6, one of the clamping cages 5 and one of the clamping springs 7.

It would also be possible to use the double-conductor connections in FIGS. 1 to 3 in a suitably dimensioned housing.

Perpendicular to a housing rear wall 15, the housing 10 has wall sections 16, which separate the clearances 11 from one another and limit them laterally. The spring support 6 and the clamp cage 5 thus form a circumferentially closed geometry in the clearance 11. This ensures that the clamping spring 7 and a conductor to be connected are well protected.

In the terminal block housing 10, one or more conductor terminal mounting devices may be provided in the area of the clearances 11 and interact with corresponding conductor terminal mounting devices at the conductor terminals.

Figure 6A:
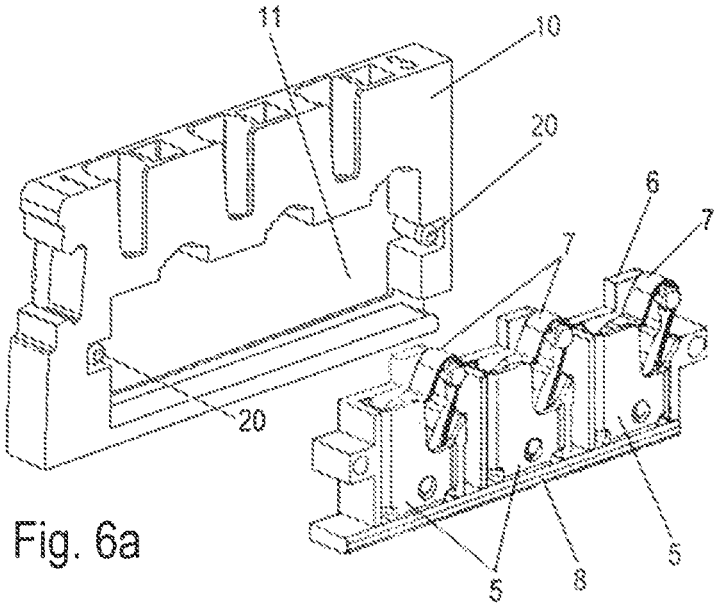
FIG. 6*a* is an exploded perspective view of a further terminal housing and a sixth conductor connection device.
Figure 6B:
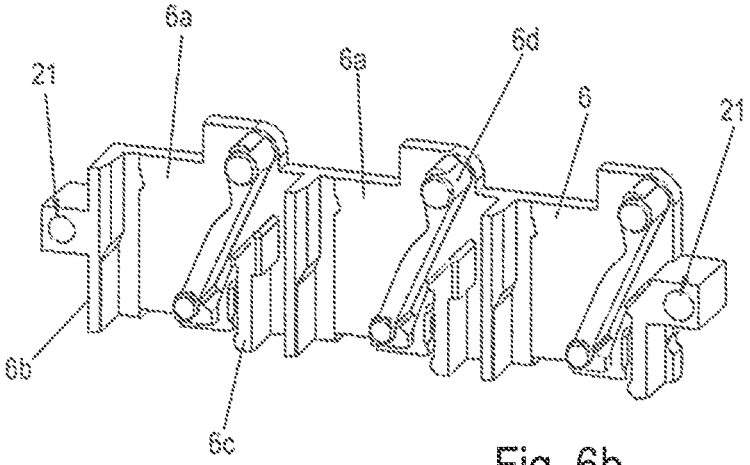
FIG. 6*b*) is a perspective view of a further spring support.

For this purpose, holes 18 are provided in the terminal block housing 10, e.g., in the area of the clearances 11, as conductor terminal mounting devices, e.g., in the housing rear wall 15 as shown in FIG. 5*a*. The holes interact with the corresponding conductor-terminal mounting devices at the conductor terminals such as pin 19 as shown in FIG. 5*b*. Alternatively, latching edges or latching pin 20 may be provided in the clearance 11 in front of the housing rear wall 15 as shown in FIGS. 6*a* and 6*b* which interact with corresponding latch recesses 21 on the spring supports 6.

It is also conceivable to integrally connect spring support 6 for several individual conductor terminals in a row to form a single part. In this case, the base wall passes through several of the spring supports 6 as shown in FIGS. 6*a*-6*c* such that a plurality of clamping springs may be arranged thereon. Alternatively, it is also possible to provide the spring supports 6 for only a single clamping spring 7 individually with latching pins.

In the terminal-block or plug housing 10, conductor insertion openings 12 and openings 13 for push buttons or turnscrews or the like may be provided in order to open the clamping point between the respective clamping leg 7*b* and the respective clamping-cage sidewall 5*b*.

Figure 1G:
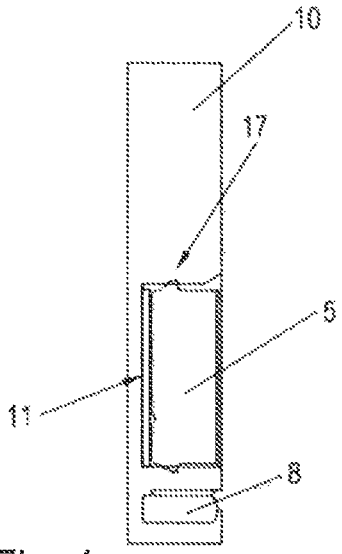
FIG. 1*g* is a front view of a clamping cage mounted within a housing.

According to another embodiment, some of the mounting devices are designed as latching devices as one or more projections 17 on one or more of the clamping cages 5. In the housing 10, one or more corresponding counter-latching devices, e.g., one or more latching edges are then formed, upon which one or more projections 17 on the clamping cages 5 are latchable. This is illustrated in FIG. 1*g*.

Figure 4B:
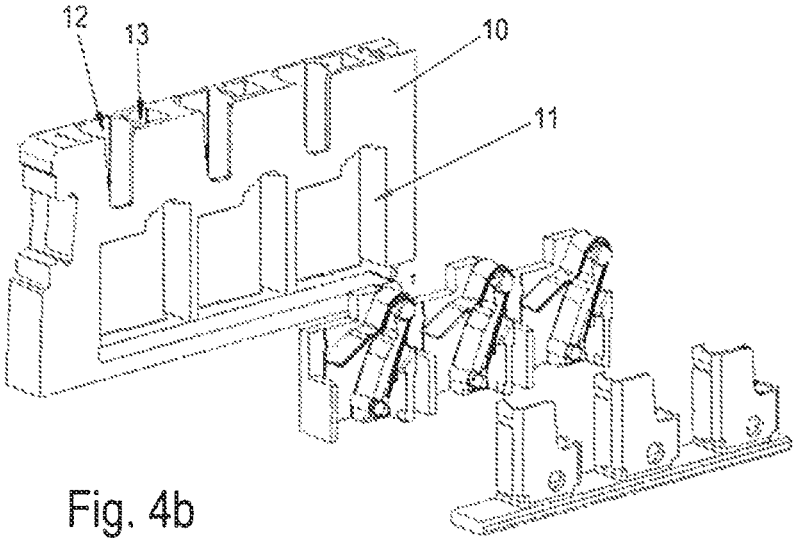
Figure 4C:
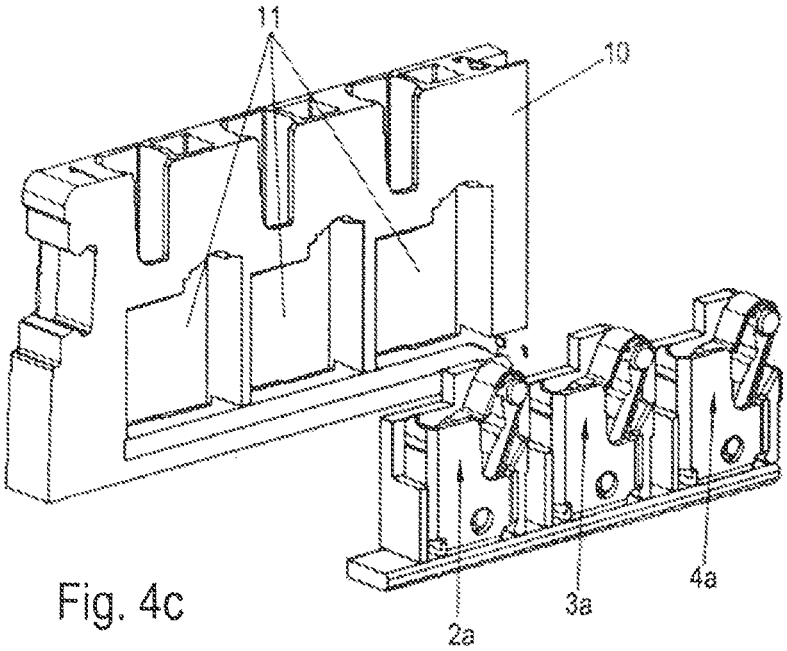
Figure 4D:
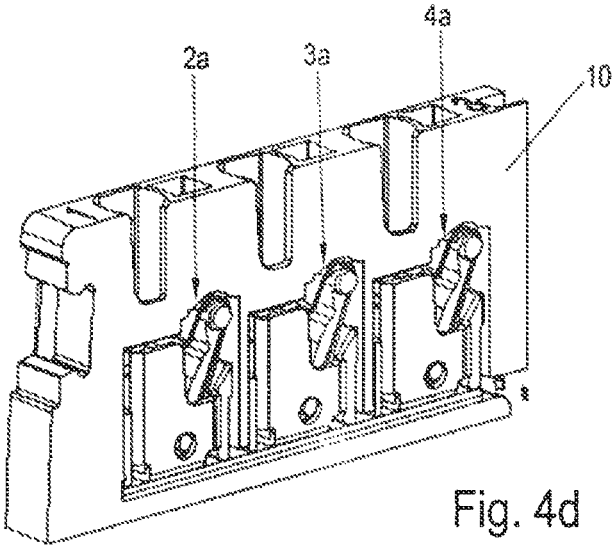

According to a preferred embodiment, during mounting, one or more clamping springs 7 are first installed on the spring supports 6 as shown in FIGS. 4*a* and 4*b*. Then one or more spring supports 6 are installed with the clamping springs 7 on the busbar 8, upon which the clamping cages 5 were previously fastened. Thus, the busbars 8 are simply pre-mountable with the conductor terminals and may be inserted as a pre-mountable unit in the terminal block housing 10, in which one or more mounting devices interact on this housing and on the spring supports 6.

The number of single-conductor terminals of the terminal block is easily variable. It is also possible to insert several of the busbars 8, 8' with conductor terminals into the housing, in particular the terminal block housing 10.

FIGS. 1 and 4 illustrate that it is possible to use the plastic part, i.e. spring carrier 6 or 6', for the double-conductor terminal as well as the single-conductor terminal.

It should also be mentioned that the spring-receiving contour 6*d* or another contour on the spring support 6 may also be designed such that a latching engagement in a latching hole 14 or the like is realized on the clamping cage 5. This facilitates pre-assembly of the spring support on the clamping cage 5 and thus on the busbar 8.

The invention claimed is:

1. A connection device for conductors, comprising at least one single-conductor terminal in the form of a direct plug-in terminal including (a) a spring support formed of a non-conductive synthetic plastic material and configured for mounting on a non-conductive receiving element;

(b) a clamping spring mounted on said spring support; and (c) a metallic clamping cage connected with said spring support, said clamping cage having a U-shaped configuration and including a clamping cage rear wall, two clamping cage sidewalls extending perpendicularly thereto, a base wall extending perpendicularly to the clamping cage rear wall and the clamping cage sidewalls, and a base socket fastening the clamping cage on a busbar, whereby when a conductor is inserted into said clamping cage, it is retained within said clamping cage by said clamping spring.

2. A connection device as defined in claim 1, wherein each spring support includes a mounting assembly formed of non-conductive material for mounting said spring support on a corresponding receiving element.

3. A connection device as defined in claim 2, wherein the receiving element for at least one spring support comprises a further spring support.

4. A connection device as defined in claim 2, wherein the receiving element for at least one spring carrier comprises one of a terminal block housing and a plug housing.

5. A connection device as defined in claim 2, wherein said spring support mounting assembly comprises an interlocking element which cooperates with an interlocking element on the receiving element.

6. A connection device as defined inn claim 5, wherein said interlocking elements comprise a pin and a hole.

7. A connection device as defined in claim 5, wherein said interlocking elements comprise latching devices on said spring support and on said receiving element, respectively.

8. A connection device as defined in claim 1, wherein said spring support has a U-shaped configuration and includes a base wall and two sidewalls extending perpendicularly thereto.

9. A connection device as defined in claim 1, wherein said spring support and said clamping cage are combined within a body having a rectangular contour.

10. A connection device as defined in claim 8, wherein said spring support has at least one spring-retaining contour extending perpendicularly to the base wall, and wherein said clamping spring has a V-shaped configuration including a support leg and a clamping leg arranged at an acute angle for installation on said spring-retaining contour, said support leg and said clamping leg being connected by a spring back.

11. A connection device as defined in claim 10, wherein said spring back engages the spring-retaining contour of the spring support.

12. A connection device as defined in claim 1, wherein a plurality of said single-conductor terminals are arranged one behind the other on a busbar in an extension direction of the busbar.

13. A connection device as defined in claim 1, wherein two of said single-conductor terminals are combined to form double-conductor terminals on a busbar.

14. A connection device as defined in claim 13, wherein each of said double-conductor terminals include two spring supports, two clamping springs, and two clamping cages combined on a mounting assembly.

15. A connection device as defined in claim 14, wherein said two single-conductor terminals of said double-conductor terminal have clamping points situated at the same location in a main extension direction of the busbar.

16. A connection device as defined in claim 14, wherein said two single-conductor terminals of said double-conductor terminal have clamping points that are offset in a main extension direction of the busbar.

17. A connection device as defined in claim 1, and further comprising a spacer configured for attachment to said spring support, and further comprising one of a further spring support and housing.

18. A connection device as defined in claim 17, wherein said spacer includes a mounting device on either or both sides, said mounting device corresponding to said mounting device for said spring support for mounting said spring support or two of said spring supports on said spacer.

19. A terminal housing as defined in claim 1, wherein said single-conductor terminal includes at least one conductor-terminal mounting device with which said single-conductor connection may be locked in a housing.

20. A connection device as defined in claim 7, wherein said latching devices are formed as one or more projections on one or more of said clamping cages, and further comprising counter-latching edges are formed in a housing upon which one or more projections are latched.

21. At least one of a terminal block and a plug having a housing and at least one terminal device as defined in claim 1.

* * * * *